US006463626B1

(12) United States Patent
Ferrari et al.

(10) Patent No.: US 6,463,626 B1
(45) Date of Patent: Oct. 15, 2002

(54) HINGE OF THE FRAME TYPE WITH AN INDEPENDENT DUAL ADJUSTMENT

(75) Inventors: Franco Ferrari, Località Deviscio, 2, 23900 Lecco (IT); Carlo Migli, Lecco (IT)

(73) Assignee: Franco Ferrari (IT)

( * ) Notice: Subject to any disclaimer, the term of this patent is extended or adjusted under 35 U.S.C. 154(b) by 86 days.

(21) Appl. No.: 09/716,059

(22) Filed: Nov. 20, 2000

(30) Foreign Application Priority Data

Nov. 29, 1999 (IT) ..... MI990718 U

(51) Int. Cl.[7] ..... E05D 7/04
(52) U.S. Cl. ..... 16/236; 16/245
(58) Field of Search ..... 16/236, 237, 238, 16/235, 242, 243, 245, 246

(56) References Cited

U.S. PATENT DOCUMENTS 4,176,422 A * 12/1979 Rock et al. ..... 16/235
4,412,366 A * 11/1983 Rock et al. ..... 16/236
4,683,612 A * 8/1987 Grass ..... 16/246
4,698,877 A * 10/1987 Lautenschlager ..... 16/236
4,776,061 A * 10/1988 Franco ..... 16/263
5,379,487 A * 1/1995 Bowers ..... 16/236
5,694,655 A * 12/1997 Strickland et al. ..... 16/238
5,755,011 A * 5/1998 Green et al. ..... 16/238
5,799,370 A * 9/1998 Davidian et al. ..... 16/236

* cited by examiner

*Primary Examiner*—Anthony Knight
*Assistant Examiner*—Doug Hutton
(74) *Attorney, Agent, or Firm*—Shlesinger, Fitzsimmons & Shlesinger

(57) ABSTRACT

A hinge of the frame type for hinging of a door to the front frame of a piece of furniture, comprising a base (11) having a rest surface (17) to be fixed to the frame of a piece of furniture, an element (16) for fastening to the door and a wing (12) which is linked to the base by position-adjusting means (13, 14) and extends at the front of the hinge until an end carrying a pivotal mounting (15) for connection with the fastening element (16). The adjusting means (13, 14) comprises a rear element (14) for adjustment of the hinge depth and a front screw (13) for adjustment of the right-left alignment of the door. The rear region (31) of the hinge around which the inclination movement between the base and wing takes place is in a lower plane than the plane passing through the rest surface of the base.

5 Claims, 1 Drawing Sheet

HINGE OF THE FRAME TYPE WITH AN INDEPENDENT DUAL ADJUSTMENT

BACKGROUND OF THE INVENTION

The present invention relates to a hinge of the so-called frame type for furniture.

Concealed hinges have been known since long which are designed to be mounted on pieces of furniture having a front bearing frame. Hinges of the frame type have been proposed which are formed of a base plate, to be fixed to the frame of the piece of furniture, on which a wing is adjustably mounted which in turn is connected by a hinge pin to a bowl which is embedded in the door of the piece of furniture. For adjustment of the position between base and wing, mutual connection of the latter is obtained by a rear cam enabling the hinge, and therefore the door, to be adjusted in depth and by a front screw enabling the right-left alignment of the door to be adjusted.

These known hinges however have the serious drawback that by operating on the front screw not only a right-left adjustment movement is caused but also a simultaneous movement in depth. This is due to the fact that the wing movement takes place according to an arc of a circumference the centre of which is close to the rear portion of the hinge and substantially in the plane of the frame surface of the piece of furniture to which the hinge base is fastened, whereas the hinge pin between the wing and bowl is greatly shifted relative to this plane to enable the door to move laterally to a sufficient degree when it is opened. Therefore, at each right-left adjustment a further depth adjustment is required to take place to compensate for the undesired displacement caused.

Due to the fact that the two adjustments depend on each other, adjustment of the doors of a piece of furniture is troublesome, imprecise and not very quick.

It is a general object of the present invention to obviate the above mentioned drawbacks by providing a hinge of the frame type having the depth adjustment and right-left adjustment independent of each other so that they can be carried out more easily. The foregoing without making the hinge structure more complicated.

SUMMARY OF THE INVENTION

In view of the above object, in accordance with the invention a hinge of the frame type for hinging a door to the front frame of a piece of furniture has been conceived which comprises a base having a rest surface to be fixed to the frame of the piece of furniture, an element for fastening to the door and a wing which is linked to the base by position-adjusting means and extends at the front of the hinge until an end carrying a pivotal mounting for connection of said fastening element to the door, the adjusting means comprising a rear element for depth adjustment of the hinge with longitudinal mutual sliding of the wing on the base and a front screw directed between the wing and base and reacting between the base and wing to provide a mutual-inclination movement between the latter around a rear region of the hinge for adjustment of the right-left alignment of the door, characterised in that the rear region of the hinge around which the inclination movement takes place is in a lower plane than a plane passing through said rest surface of the base.

BRIEF DESCRIPTION OF THE DRAWINGS

For better explaining the innovatory principles of the present invention and the advantages it offers over the known art, a possible embodiment applying such principles will be given hereinafter by way of non-limiting example, with the aid of the accompanying drawings, in which.

DETAILED DESCRIPTION OF THE INVENTION

Figure 1:
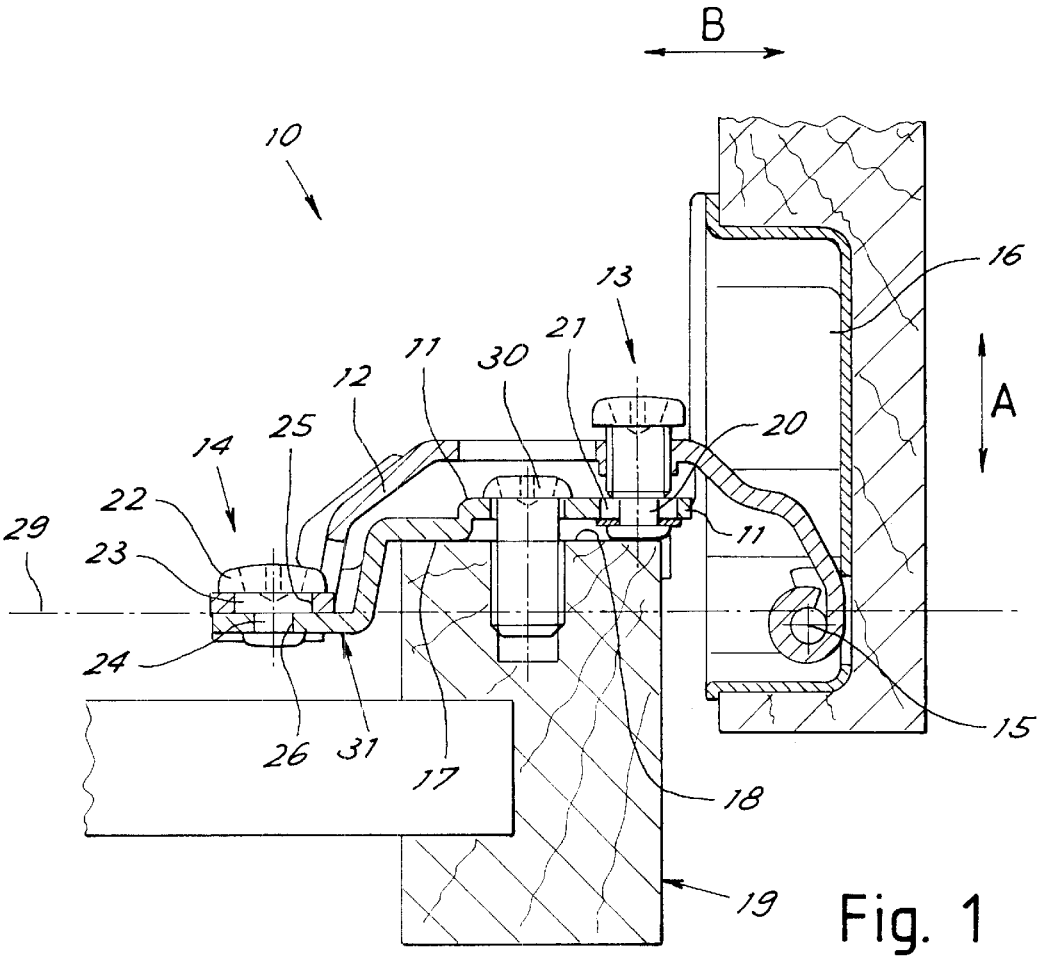
FIG. 1 is a longitudinally sectioned side view , of a hinge in accordance with the invention.

With reference to the drawings, shown in FIG. 1 is a frame hinge generally denoted by 10. This hinge comprises a fixing base 11 with which a wing 12 is coupled the position of which is adjustable on the base by front adjusting elements 13 and rear adjusting elements 14. At the front the wing terminates with a hinge pin for connection to an element 16 in the form of a bowl for example, for fastening to the door.

The base 11 has a lower mounting surface 17 adapted to rest on the side surface 18 of the front frame. 19 of the piece of furniture. A screw 30 passes through the base to secure it to the piece of furniture. The front portion of the wing carrying the pin bends downwardly to advantageously bring the pivotal mounting out of the opening in the abutting frame of the door. The term "downwardly" as herein defined means the fixing direction of the base to the piece of furniture, i.e. downwardly relative to the hinge, which does not necessarily coincide with the "downwardly direction in space".

Figure 2:
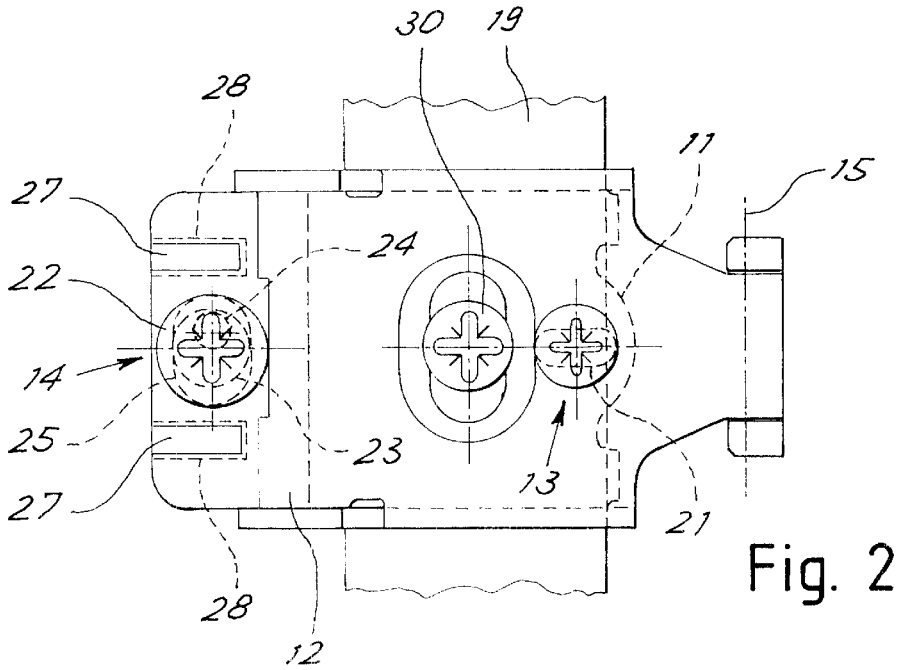
FIG. 2 is a plan view of the hinge shown in FIG. 1, in which a fastening bowl-shaped element is removed.

The front adjusting means comprises a screw 13 which is screwed down in an appropriate seating in the wing and has a shank with an end constrained to slide in an elongated hole 21 in the base extending in a direction longitudinal to the hinge, as clearly seen also in FIG. 2. The rear adjusting means, on the contrary, comprises an eccentric 14 consisting of a head 22, a coaxial cylindrical portion 23 and a cylindrical shank 24 which is out of centre with respect to the head axis. The cylindrical portion 23 is fitted in an oval cavity 25 extending transversely of the wing 12. Portion 23 is received in the cavity with a minimum clearance in the direction of the longitudinal axis of the hinge and in such a manner that the head 22 rests on the wing surface. Shank 24 is fitted in a hole 26 in the base and riveted.

It is apparent that a rotation of cam 14 causes a parallel movement between the base and wing, so that the door moves in the direction indicated by arrow B in FIG. 1, carrying out a so-called "depth" adjustment, whereas a rotation of screw 13 causes an inclination of the front portion of the wing with respect to the base around an axis transverse to the hinge and passing close to the rear cam, so that the wing moves in the direction A, carrying out a hinge adjustment corresponding the "right-left" adjustment of the door.

To guide sliding imposed by the cam, the wing can have drawn portions 27 matching with respective drawn portions 28 in the base.

In order to have the necessary yielding quality for inclination of the wing with respect to the base, the wing and base are substantially in contact only in the rear region where the inclination axis is wished to pass, i.e. close to the rear cam.

This contact between the base and wing takes place in a plane 29 which is also the mutual sliding plane for depth adjustment, which is lower than the fixing plane 17 of the base. In more detail, plane 29 advantageously passes close to pin 15.

To do this, the rear end 31 of the base made of sheet metal is curved so that it is disposed in a lower plane than the rest plane 17. The rear portion of the wing is correspondingly bent.

At this point it is apparent that the intended purposes have been reached. Since hinging between the base and wing (substantially the cam adjustment plane) is placed at a lower position than the rest plane of the base on the piece of furniture and therefore in a plane (parallel to the sliding plane between the base and wing) closer to pin 15, the arc-shaped movement of pin 15 when adjustment of screw 13 occurs has a tangent that, for the small desired adjustment, is substantially parallel to direction "A", without any component in the direction "B". The two adjustments are therefore independent of each other.

Obviously, the above description of an embodiment applying the innovatory principles of the present invention is given by way of example only and therefore must not be considered as a limitation of the inventive scope as herein claimed. For instance, the exact shape and proportions of the parts can vary depending on particular requirements.

What is claimed is:

1. A hinge of the frame type for hinging of a door to a front frame of a piece of furniture, comprising a base having a rest surface to be fixed to the frame of the piece of furniture, an element for fastening to the door and a wing which is linked to the base by position-adjusting means and extends at the front of the hinge until an end carrying a pivotal mounting for connection of said fastening element to the door, the adjusting means comprising a rear element for depth adjusting of the hinge with longitudinal mutual sliding of the wing on the base and a front screw directed between the wing and base and reacting between the base and wing to supply a mutual-inclination movement between the base and wing around a rear region of the hinge for adjustment of the right-left alignment of the door, characterised in that the rear region of the hinge around which the inclination movement takes place is in a lower plane than a plane passing through said rest surface of the base.

2. A hinge as claimed in claim 1, wherein said lower plane substantially passes close to the pivotal mounting between the wing and the fastening element to the door.

3. A hinge as claimed in claim 1, wherein the rear element comprises a cam reacting between the wing and base in a direction longitudinal to the hinge.

4. A hinge as claimed in claim 1, wherein the front screw is screwed down in the wing and has an end constrained to slide in a longitudinal elongated hole in the base.

5. A hinge as claimed in claim 3, wherein the rear portion of the base and the wing are curved so as to reach a lower plane than said rest surface and in that the base and wing are in slidable contact at a region of the rear portion which is in this lower plane and in which the adjustment cam is present.

* * * * *